US005433314A

United States Patent [19]

Lin

[11] Patent Number: 5,433,314

[45] Date of Patent: Jul. 18, 1995

[54] SEPARABLE RECEPTACLE FOR RECEIVING CONTACT LENSES

[76] Inventor: Lien-Sheng Lin, 1st Fl., No. 33, Lih Nong St., Pei-Tou District, Taipei, Taiwan

[21] Appl. No.: 270,361

[22] Filed: Jul. 5, 1994

[51] Int. Cl.[6] ..... A45C 11/04

[52] U.S. Cl. ..... 206/5.1; 134/901; 220/23.4

[58] Field of Search ..... 206/5.1, 504, 205; 134/901; 220/23.4, 23.6

[56] References Cited

U.S. PATENT DOCUMENTS

| | | | |
|---|---|---|---|
| 2,948,387 | 8/1960 | Fishman | 206/5.1 X |
| 3,645,284 | 2/1972 | Krezanoski et al. | 206/5.1 X |
| 3,768,633 | 10/1973 | Nathan | 206/5.1 X |
| 4,550,837 | 11/1985 | Simmons | 220/23.6 X |
| 4,886,239 | 12/1989 | Stimmel | 220/23.4 X |
| 5,224,593 | 7/1993 | Bennett | 206/5.1 |
| 5,263,576 | 11/1993 | Boreen et al. | 220/23.4 X |

FOREIGN PATENT DOCUMENTS 2310940 12/1976 France .

*Primary Examiner*—Jacob K. Ackun

*Attorney, Agent, or Firm*—Peterson, Wicks, Nemer & Kamrath

[57] ABSTRACT

A separable receptacle for receiving contact lenses includes a left part and a right part in both of which a recess is defined and the left and right parts are engaged by an engaging device. The engaging means includes a first plate projecting from the left part and a second plate projecting from the right part and at least one protrusion/tubular element projecting from the first plate and a corresponding tubular element/protrusion projecting from the second plate wherein the tubular element has a receiving hole defined therein for secure engagement to the corresponding projection.

15 Claims, 2 Drawing Sheets

SEPARABLE RECEPTACLE FOR RECEIVING CONTACT LENSES

BACKGROUND OF THE INVENTION

The present invention relates to a separable receptacle for receiving contact lenses and more particularly, to a receptacle including a left part and a right part which are separably engaged to each other by an engaging means.

A contact lens receptacle now popularly used is an integrally formed piece which has a left recess and a right recess defined therein for receiving the contact lenses of left and right eyes respectively. Each recess is defined by a flange projecting upwardly from the element and each of which has a cover to mount thereon for preventing contaminants from entering therein. However, only the covers have a corresponding mark, "L" or "R" for example, marked thereon to distinguish which recess receives the contact lens of the left or right eye therein, therefore confusion could ensue if the covers are mis-mounted.

Further, such a regular type of the receptacle is formed as an oblong strip in order to receive the contact lenses horizontally and that has inconvenience when storing, especially when stored in small spaces, for example in a hand bag. Furthermore, as some people, although very few, need only one contact lens, the receptacle described above therefore cannot meet such a requirement satisfactorily.

The present invention intends to provide a contact lens receptacle which is able to be separated into two parts which are engaged by an engaging means, this invention, of course, can mitigate and/or obviate the above-mentioned problems.

SUMMARY OF THE INVENTION

The present invention provides a receptacle for receiving contact lenses, which is composed of a left part and a right part and the two parts are engaged by an engaging means such that the receptacle is separable when needed.

Objects, advantages, and novel features of the invention will become more apparent from the following detailed description when taken in conjunction with the accompanying drawings.

DETAILED DESCRIPTION OF THE PREFERRED EMBODIMENT

Figure 1:
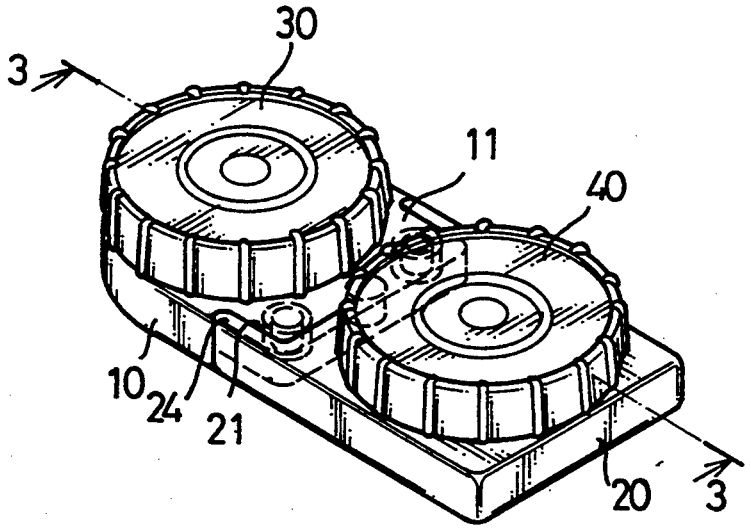
FIG. 1 is a perspective view of a separable receptacle in accordance with the present invention.
Figure 2:
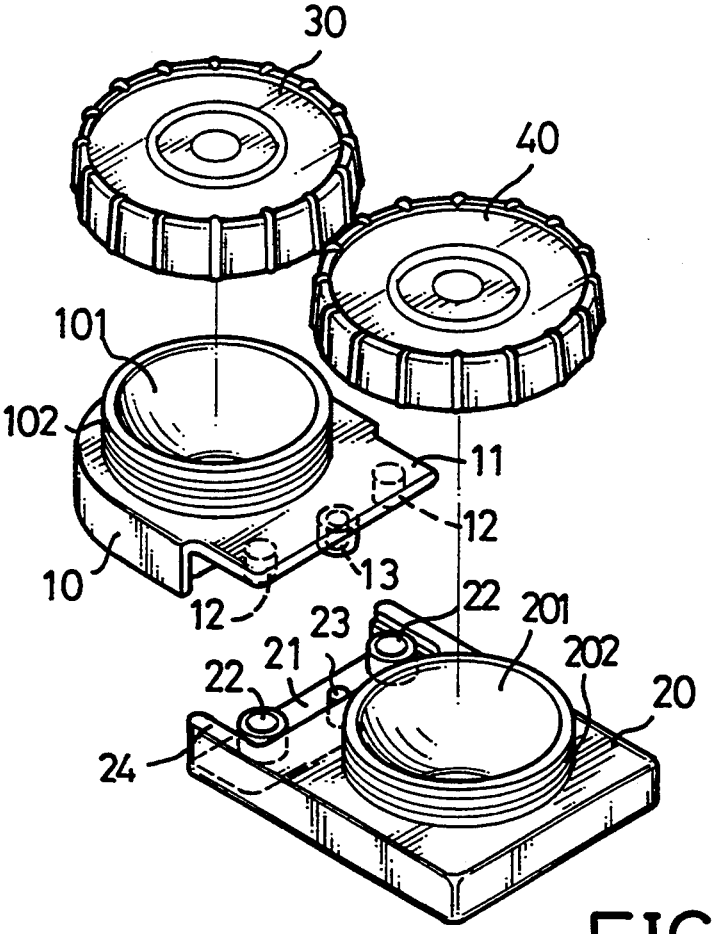
FIG. 2 is an exploded view of the receptacle in accordance with the present invention.
Figure 3:
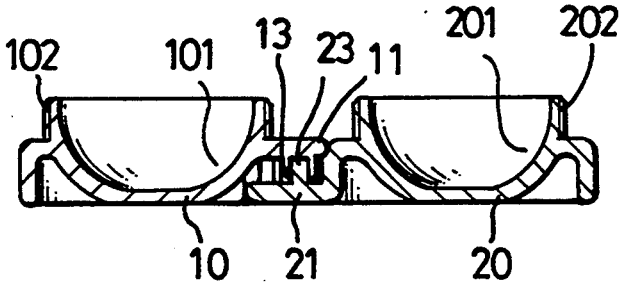
FIG. 3 is a side elevational view, partly in section, of the receptacle in accordance with the present invention.

Referring to the drawings, a separable receptacle in accordance with the present invention generally includes a left part 10 and a right part 20 which has a recess 101, 201 respectively defined therein and is defined by a flange 102, 202 projecting from the left and right parts 10, 20. Each flange 102, 202 has a threaded portion defined therein for engagement with a cover 30, 40. The left part 10 and the right part 20 are engaged by an engaging means which includes a first plate 11 projecting from the left part 10 and a second plate 21 projecting from the right part 20. The first plate 11 has two protrusions 12 and a tubular element 13 projecting from an under side thereof and the second plate 21 has two tubular elements 22 and a protrusion 23 projecting from a upper side thereof such that the positions of the protrusions 12 are correspondent to the tubular elements 22 and the tubular element 13 is correspondent to the protrusion 23 respectively. The protrusions 12, 23 are securely engaged to a receiving hole of respective tubular elements 13, 22 when the left part 10 and the right part 20 are engaged. The second plate 21 has two side walls 24 projecting from both sides thereof such that the first plate 11 can be mounted to the second plate 21 between the side walls 24 forming a smooth configuration.

Accordingly, the separable receptacle in accordance with the present invention may engage the left and right parts 10, 20 and be used as conventionally, and which is also separable when needed.

Although the invention has been explained in relation to its preferred embodiment, it is to be understood that many other possible modifications and variations can be made without departing from the spirit and scope of the invention as hereinafter claimed.

I claim:

1. A separable receptacle for receiving contact lenses, comprising, in combination: a left part comprising a left cover with a threaded inner surface and a left base including means for receiving one contact lens comprising a recess defined therein by a flange projecting upwardly with a threaded outer surface to cooperate with the left cover and a first engaging plate projecting therefrom; a right part comprising a right cover with a threaded inner surface and a right base including means for receiving one contact lens comprising a recess defined therein by a flange projecting upwardly with a threaded outer surface to cooperate with the right cover and a second engaging plate projecting therefrom; and at least first means for releasably engaging the first and second engaging plates, with the engaging means each comprising a protrusion extending from one of the first and second engaging plates and a tubular element having a receiving hole defined therein for securely engaging the protrusion and extending from the other of the first and second engaging plates.

2. The receptacle of claim 1 wherein the second engaging plate includes first and second sides; and wherein the right part further includes first and second side walls projecting from the first and second sides of the second engaging plate, with the first engaging plate located between the first and second side walls when the tubular element securely engages the protrusion.

3. The receptacle of claim 2 wherein the first and second side walls upwardly project from the second engaging plate, with the releasably engaging means extending upwardly from the second engaging plate and downwardly from the first engaging plate.

4. The receptacle of claim 3 further comprising, in combination: a second engaging means.

5. The receptacle of claim 4 wherein the engaging means includes at least one protrusion and one tubular element extending from each of the first and second engaging plates.

6. The receptacle of claim 5 further comprising, in combination: a third engaging means.

7. The receptacle of claim 6 wherein the engaging means includes first and second protrusions extending from one of the first and second engaging plates and first and second tubular elements extending from the other of the first and second engaging plates.

8. The receptacle of claim 4 wherein the engaging means includes first and second protrusions extending from one of the first and second engaging plates and first and second tubular elements extending from the other of the first and second engaging plates.

9. The receptacle of claim 1 wherein the protrusion and tubular element extend parallel to the flange.

10. The receptacle of claim 1 wherein the flange of the left base is parallel to and spaced from the flange of the right base when the protrusion securely engages the tubular element.

11. The receptacle of claim 1 further comprising, in combination: a second engaging means.

12. The receptacle of claim 11 wherein the engaging means includes at least one protrusion and one tubular element extending from each of the first and second engaging plates.

13. The receptacle of claim 12 further comprising, in combination: a third engaging means.

14. The receptacle of claim 13 wherein the engaging means includes first and second protrusions extending from one of the first and second engaging plates and first and second tubular elements extending from the other of the first and second engaging plates.

15. The receptacle of claim 11 wherein the engaging means includes first and second protrusions extending from one of the first and second engaging plates and first and second tubular elements extending from the other of the first and second engaging plates.

* * * * *